United States Patent [19]

Van Perlstein et al.

[11] Patent Number: 4,985,090

[45] Date of Patent: Jan. 15, 1991

[54] NON-AGEING LOW-ALLOY HOT-ROLLED STRIP-FORM FORMABLE STEEL

[75] Inventors: Erik B. Van Perlstein, Beverwijk; Huibert W. den Hartog, Noordwijkerhout, both of Netherlands

[73] Assignee: Hoogovens Groep B.V., IJmuiden, Netherlands

[21] Appl. No.: 535,310

[22] Filed: Jun. 8, 1990

Related U.S. Application Data

[63] Continuation-in-part of Ser. No. 307,477, Feb. 8, 1989, abandoned.

[30] Foreign Application Priority Data

Feb. 17, 1988 [NL] Netherlands ..... 8800391

[51] Int. Cl.[5] ..... C22C 38/14

[52] U.S. Cl. ..... 148/320; 420/126

[58] Field of Search ..... 148/320, 12 F; 420/126

[56] References Cited

U.S. PATENT DOCUMENTS

| | | | |
|---|---|---|---|
| 3,765,874 | 10/1973 | Elias et al. | 148/2 |
| 4,141,761 | 2/1979 | Abraham et al. | 148/320 |
| 4,586,966 | 5/1986 | Okamoto et al. | 148/12 C |

FOREIGN PATENT DOCUMENTS

| | | |
|---|---|---|
| 931662 | 8/1955 | Fed. Rep. of Germany . |
| 2362658 | 7/1974 | Fed. Rep. of Germany . |
| 1335355 | 7/1963 | France . |
| 1511529 | 1/1968 | France . |
| 2115327 | 7/1972 | France . |
| 68974 | 9/1969 | German Democratic Rep. . |

*Primary Examiner*—Deborah Yee

*Attorney, Agent, or Firm*—Stevens, Davis, Miller & Mosher

[57] ABSTRACT

A non-ageing low-alloy hot-rolled strip-form formable steel has a carbon content of between 0.02 and 0.10 wt. % and a thickness of between 0.5 and 5.0 mm. In order to bind N so as to achieve a non-ageing steel, while permitting direct entry of the steel to rolling from casting, the contents of titanium, nitrogen and sulphur in wt. % satisfy the conditions:

$$Ti \geqq 2.28\ N$$

$$Ti \leqq 3.43\ N + 1.5\ S$$

and the steel is free from titanium carbide and niobium carbide and contains nitrogen in an amount of less than 0.007 wt. %.

3 Claims, No Drawings

NON-AGEING LOW-ALLOY HOT-ROLLED STRIP-FORM FORMABLE STEEL

This application is a Continuation-in-Part of application Ser. No. 307,477, filed Feb. 8, 1989, now abandoned.

BACKGROUND OF THE INVENTION

1. FIELD OF THE INVENTION

The invention relates to a non-ageing low-alloy hot-rolled strip-form formable steel. The steel has good mechanical and surface properties. Typically such a steel has a thickness in the range 0.5 to 5.0 mm.

2. DESCRIPTION OF THE PRIOR ART

A low-alloy hot-rolled steel strip of a given thickness and a given C-content may be obtained in accordance with a known method in which a cast steel slab with a thickness of between 25 and 300 mm is first cooled down and then before hot-rolling heated up to, and homogenized at, a temperature of between 1100° C. and 1250° C.

As the slab cools down any nitrogen present in the steel combines with aluminum into aluminium nitride. This binding of N is preserved as the slab is heated up again if the temperature is kept not higher than about 1100° C. This gives a product which is non-ageing.

If the steel is heated to higher temperatures, free nitrogen goes increasingly into solution in the steel, which means that the steel becomes less non-ageing. This ageing occurs in particular after pickling and re-rolling of the hot-rolled steel strip. This ageing has a disadvantageous effect on the mechanical properties of the formable steel. During forming of age-hardened steel, flow lines develop on the surface, which means that the surface quality of the finished product is not ideal.

Also if the slab is not sufficiently cooled before being re-heated, or if it is taken directly from the casting heat into an homogenizing furnace, free nitrogen will remain present in the steel, because nitrides are unable to form. Then also non-ageing material is not obtained, even if the furnace temperature is low. For reasons of energy saving and stock limiting it is becoming increasingly common not to cool the cast slabs down to ambient temperature but to place them in the furnace at a higher temperature or even send them through a furnace directly after casting. In addition, for reasons of savings in energy and savings in material and product properties, it is sought to reduce the furnace temperature down to 1000° C. or even down to 850° C. So, in this known method, the energy saving desired is impossible if it is intended to manufacture a non-ageing product.

It is to be noted that dissolved nitrogen in the steel may also have a disadvantageous influence on the achievement of a good strip shape and an even thickness. In particular this is the case when, for reasons of energy saving, a low temperature in the re-heating furnace is sought. A low temperature in the re-heating furnace implies low rolling temperatures. At these relatively low rolling temperatures, dissolved nitorgen impedes a complete recrystallization of the steel between the different forming stages in the hot-rolling process. This means that the hardness of the steel may vary considerably during forming, leading to the drawbacks described.

Dissolved nitrogen may also prevent a complete recrystallization of the hot-rolled steel, if the steel is coiled at a temperature below 700° C. A coiling temperature below 700° C. is desirable from the point of view of oxide control and homogeneity of mechanical properties. The level of mechanical properties is seriously affected by incomplete recrystallization.

Some specific prior art proposals will be referred to below, where they are more easily discussed in the light of the following explanation of the present invention.

SUMMARY OF THE INVENTION

The object of the invention is to provide a non-ageing formable steel strip product which may be manufactured inexpensively and by which all or most of the problems described above may be avoided or reduced.

The invention consists in that the steel from which the product is manufactured, is alloyed with a sufficient amount of titanium in order to bind at least some, preferably substantially all, N present in the molten steel but not to produce titanium carbide. This is achieved, with a carbon content in the range 0.02 to 0.1 wt. % by selection of contents of non-oxide bound titanium, nitrogen and sulphur in wt. % which satisfy the following conditions $$Ti \geqq 2.28\ N$$

$$Ti \leqq 3.43\ N + 1.5\ S$$

and by selection of the Ti (and Nb) content in relation to the C content so that the steel is free from titanium carbide and niobium carbide. The binding of the nitrogen is maintained during subsequent treatments of the steel, the cast slab and the rolled steel strip. The steel strip has an iron content of From 98.514–99.971 wt.%. Ageing phenomena are prevented in this way irrespective of the way in which the steel is processed into slab and strip. This creates the freedom to convey the slab, still hot from the casting heat, into the homogenization furnace, or to run the furnace at a relatively low temperature, or to coil the strip at a temperature below 700°C.

It is to be noted that the addition of Ti to steel is known, but in combination with other carbon contents in the steel, and in order to obtain other effects. Equally, adding between 0.05 and 0.30% Ti to a steel with between 0.03 and 0.15% C is known for the manufacture of a formable steel with high strength. In such cases, the Ti content is considerably higher than is needed for binding N into nitrides, so that titanium carbide precipitates form which have a strengthening effect.

Also known is an application in which by adding titanium to ultra-low-carbon steel a so-called "Interstitial Free" deep drawing steel is obtained. This steel has a carbon content below 0.01% C (specific value for example 0.003% C). This ultra-low carbon content is obtained by decarbonizing the liquid steel under vacuum, which also makes practically all dissolved nitrogen disappear. This stage of the process increases the cost price of the steel. Sufficient titanium must be added to "Interstitial Free" deep-drawing steel in order to bind all carbon. Practical values for the titanium content in the steel lie between 0.03 and 0.15% Ti.

An alternative to this "Interstitial Free" deep drawing steel is a steel with ultra-low carbon content to which titanium and niobium in combination are added. Such a steel has a composition with for example 0.003% C, 0.01% Ti and 0.02% Nb.

FR-A-2115327 describes a steel product containing very low carbon content (<0.01%, e.g. 0.004%) achieved by decarbonization at 750°C. Ti is present in order to form nitrides and carbides, which are described as significant for the desired properties.

U.S. Pat. No. 3765874 similarly proposes a vacuum-degassed, low carbon (0.002–0.020% C, preferably 0.002 to 0.01% C) steel in which Ti and Nb are present in amounts chosen to bind all C as carbides.

In contrast to these known types of steel the present invention provides a steel which does not need to be decarbonized under vacuum and in which titanium carbide or niobium carbide does not form. The purpose of adding titanium is only to bind the unavoidable nitrogen in the steel in a stable form, so that the problems mentioned earlier are prevented and a well formable hot-rolled steel may be obtained at low cost price.

The best properties are achieved for this if the following conditions are satisfied for nitrogen, sulphur and non-oxide bound titanium:

$$Ti \geqq 3.42\ N$$

$$Ti \leqq 3.43\ N + 1.5\ S$$

In order to bind the nitrogen in steel into nitrides, it is known to add a small quantity of boron to the steel in the weight ratio $B/N \sim 0.77$. However, boron nitrides are much less stable than titanium nitrides. Boron nitrides form partly during hot-rolling and partly during the slow cooling down of the coiled hot-rolled coil, provided that the coiling temperature is sufficiently high. However, titanium nitride forms completely at high temperature during the casting process. During further processing the titanium nitrides remain stable. Thus the steel in accordance with the invention also does not need to be coiled at high temperature. A low coiling temperature is very favorable for the preservation of a good homogenity over the strip length and for restricting the growth of oxide scale on the hot-rolled strip.

If it is intended to manufacture a hot-rolled strip with a thickness of between 0.5 and 1.5 mm, then of necessity the last reduction stage must take place in a temperature range where the steel essentially has a ferrite crystal structure. The dispersal of boron nitride in this temperature range impedes a complete recrystallisation of the steel after the last reduction stage. Therefore with boron present and without titanium, steel strip with good mechanical properties cannot be obtained. With the steel in accordance with the invention, in which nitrogen is bonded into titanium nitride this problem does not arise.

In the invention, a preferred minimum level for C is 0.03 wt. %. For N a typical minimum level is 0.001 wt. % and the preferred maximum is 0.007 wt. %. For S a typical minimum level is 0.005 and the preferred maximum content is 0.05 wt. %. For Ti added the range is from 0.00228–0.099 wt. %. Other alloying elements may be present within the requirements for a non-ageing, low alloy hot-rolled formable strip steel. While it is not necessary to specify to an expert all such elements and their preferred contents, the following guidance is given:

Al is optional, and if present its preferred maximum is 0.1 wt. %, and its more preferred range is 0.003–0.006 wt. %.

Mn is optional, and if present its preferred maximum is 1.0 wt. %, and its more preferred range is 0.1 to 0.5 wt. %.

Nb is preferably absent, but may be present in trace amounts and not more than 0.02 wt. %.

B is preferably absent, but may be present in trace amounts and not more than 0.01 wt. %.

Zr and V are preferably absent or present in trace amounts only.

P, Cr and Si may optionally be present. Si is present in less than 0.1 wt. %.

As is normal, unavoidable impurities are present.

The invention also provides a method for manufacture of the steel strip of the invention described above. In this, a cast steel slab with the composition as defined above for the steel is thermally homogenized from the casting heat and then hot-rolled.

The steel may be hot-rolled to the final thickness or may be hot-rolled and then cold-rolled to give the final thickness. Following cold-rolling, recrystallization annealing is preferred. The titanium content is preferably added to the melt, before casting.

In production methods practised up to now, a steel slab is cast with a thickness of between 200 and 250 mm. Recent developments in casting technology have made it possible to cast slabs with a thickness of between 30 and 60 mm. These thin slabs do not need any rough-rolling and consequently may be put directly into a finishing train. In principle this development permits a lower furnace temperature, which means that energy may be saved and the material loss as a result of oxidation is less. The steel of the invention proposed above is extremely suitable for this new production technique. It is even possible to convey the thin slabs in a semi-continuous or continuous process directly after casting into the homogenization furnace and then into the finishing train. In this case the slab cannot be maintained for sufficient time at such a temperature that aluminium nitrides precipitate. With such a method the steel of the invention is highly useful for obtaining a non-ageing steel strip with good mechanical properties.

If it is intended to use the method as described above to produce, from non-decarbonized steel a hot-rolled strip with a thickness of between 0.5 and 1.5 mm and with good mechanical properties and where required with a thin oxide layer, then good results are obtained with the steel in accordance with the invention. In fact it has been found that titanium is the sole element which may be added to the steel at acceptable costs and which binds nitrogen in such a way that a completely recrystallized hot-rolled strip with a thickness of between 0.5 and 1.5 mm can be obtained. The hot-rolled strip described in accordance with the invention has also been found very suitable to be put through other processes such as pickling, cold-rolling, annealing and/or galvanizing after hot-rolling.

EXAMPLES

The invention will be illustrated non-limitatively by reference to a number of preferred and comparative examples, whose analysis is set out in Table 1 below.

In Table 1, steels (A) and (B) are low-carbon steels in accordance with the invention. Both steels are refined in accordance with a known production process in an oxygen steel converter. After the steel has been killed with aluminium in the ladle, the prescribed quantity of titanium is added to the steel in order to bind the nitrogen unavoidably present in the steel.

Steels (C) and (D) are "Interstitial Free" deep-drawing steels which are decarbonized under vacuum after refining in the oxygen steel converter, whereupon a quantity of titanium and/or niobium is added to the steel which is sufficient to bind all nitrogen and carbon into nitrides and carbides respectively. These steels do not fall within the scope of the invention.

Steel (E) is a low-carbon steel, to which too little titanium is added for binding all nitrogen into stable nitrides. Because thanks to this small addition a sufficiently clear improvement in properties was in fact found, as described herein, this steel does fall within the scope of the invention.

Steel (F) is a steel that is killed under vacuum after the oxygen steel process, whereupon the quantity of titanium prescribed in accordance with the invention is added to the steel. Therefore, this steel does fall within the scope of the invention.

Steel (G) is a formable steel with increased strength which does not fall within the scope of the invention. The increase in strength in this steel is the result of precipitation-hardening by titanium carbides.

Steel (H) is a low-carbon steel to which boron is added and not titanium. This steel does not fall within the scope of the invention.

Steel (I) is a low-carbon steel, to which more titanium is added than is permitted in accordance with the invention. In this steel fine titanium carbides form which impede the recrystallization of the strip during hot-rolling. Therefore, this steel does not fall within the scope of the invention.

TABLE 1

| Example | % C | % Mn | % Al | % S | % Ti | % N | % Nb | % B |
|---|---|---|---|---|---|---|---|---|
| A | 0.027 | 0.210 | 0.041 | 0.009 | 0.015 | 0.0034 | — | — |
| B | 0.046 | 0.206 | 0.035 | 0.013 | 0.012 | 0.0021 | — | — |
| *C | 0.003 | 0.187 | 0.048 | 0.010 | 0.052 | 0.0024 | — | — |
| *D | 0.002 | 0.184 | 0.042 | 0.009 | 0.015 | 0.0026 | 0.021 | — |
| E | 0.046 | 0.221 | 0.050 | 0.009 | 0.009 | 0.0029 | — | — |
| F | 0.045 | 0.208 | 0.006 | 0.011 | 0.017 | 0.0033 | — | — |
| *G | 0.043 | 0.256 | 0.038 | 0.011 | 0.052 | 0.0022 | — | — |
| *H | 0.041 | 0.198 | 0.043 | 0.012 | — | 0.0031 | — | 0.0027 |
| *I | 0.048 | 0.206 | 0.046 | 0.008 | 0.028 | 0.0024 | — | — |

The steels marked * do not belong to the invention

We claim:

1. Non-ageing, low-alloy, hot-rolled, strip-formed formable steel having less than 0.1% Si, from 98.514–99.971 wt. % Fe and having a carbon content in the range 0.02 to 0.10 wt. % and a thickness in the range 0.5 to 5.0 mm, wherein the contents of non-oxide bound titanium, nitrogen and sulphur in wt. % satisfy the conditions:

$$Ti \geqq 2.28N$$

$$Ti \leqq 3.43N + 1.5S$$

and the steel is free from titanium carbide and niobium carbide

2. Steel in accordance with claim 1 wherein the contents of non-oxide bound titanium, nitrogen and sulphur satisfy the conditions:

$$Ti \geqq 3.42N$$

$$Ti \leqq 3.43N + 1.5S.$$

3. Steel in accordance with claim 1 wherein the content of sulphur is less than 0.05 wt. %.

* * * * *